United States Patent [19]

Hesse

[11] Patent Number: 5,074,364

[45] Date of Patent: Dec. 24, 1991

[54] RAM BORING MACHINE

[75] Inventor: Alfons Hesse, Lennestadt, Fed. Rep. of Germany

[73] Assignee: Paul Schmidt, Lennestadt, Fed. Rep. of Germany

[21] Appl. No.: 360,017

[22] Filed: Jun. 1, 1989

[30] Foreign Application Priority Data

Oct. 5, 1988 [DE] Fed. Rep. of Germany ..... 3833882

[51] Int. Cl.[5] ..... B25D 17/24

[52] U.S. Cl. ..... 173/91; 173/139; 173/162.1

[58] Field of Search ..... 173/91, 139, 162.1; 175/19; 91/234

[56] References Cited

U.S. PATENT DOCUMENTS 3,179,185 4/1965 O'Farrell ..... 173/139 X
3,756,328 9/1973 Sudnishnikov et al. ..... 173/91
3,763,939 10/1973 Sudnishnikov et al. ..... 173/91
4,385,665 5/1983 Knoll ..... 173/162.1
4,733,731 3/1988 Tkach et al. ..... 173/91

*Primary Examiner*—Frank T. Yost
*Assistant Examiner*—Scott A. Smith

[57] ABSTRACT

In a ram boring machine having a striking piston that can be moved axially in a housing and whose movements are controlled by a control pipe that is connected to a compressed air hose and is mounted in an elastic intermediate piece arranged in the housing, arranging the elastic intermediate piece on the control pipe and/or in the housing facilitates the assembly of the intermediate piece. Furthermore there is less damage to the housing, the control pipe and the compressed air hose and even the control pipe can be mounted and disassembled easier.

5 Claims, 3 Drawing Sheets

RAM BORING MACHINE

TECHNICAL FIELD OF THE INVENTION

The invention relates to a ram boring machine having a striking piston moving axially in a housing whose movements are controlled by a control pipe that is connected to a compressed air hose and is mounted in an elastic intermediate piece arranged in the housing.

BACKGROUND OF THE INVENTION AND PRIOR ART

A ram boring machine of this kind is disclosed in U.S. Pat. No. 3,995,702. The elastic intermediate piece here acts as damping block and when the machine is in operation absorbs unavoidable shocks and vibrations; these influences should be kept from the reversing gear as far as is possible. Mounting, i.e. installing and disassembling this damping block however requires troublesome manipulation and has considerable disadvantages because the annular damping block is accommodated between a sleeve screwed on to the control pipe and an end piece screwed into the rear end of the machine housing and is secured in its assembled position. Thus, both the damping block and the end piece and the sleeve must be provided with threads, which involves additional manufacturing costs. Aside from this, the screw connection, in particular when unscrewing after the machine has been in operation for a while, causes a lot of difficulties which are particularly due to the adverse influences when making tunnels in the ground which lead to contamination and which are even greater in the case of large machines having diameters reaching up to 450 mm. So that the screw connection does not loosen or become detached due to the vibrations the screw parts are, as a rule, provided with a delicate fine thread and furthermore are often in addition stuck to one another. When disassembling the block this bond has then to be broken by heating at least the threaded sections of the screw parts, so that damage to the damping block caused by heat cannot be avoided.

Other known ram boring machines have a control pipe that is screwed into the rear end of the housing. The control pipe is either in one piece and has an end piece with an external thread which has axial air outlet openings arranged concentrically with the control pipe, or else the end piece is a part separate from the control pipe which is screwed on to the rear end of the control pipe and, together with the control pipe, is screwed into the end of the housing. So that the end piece does not separate from the control pipe or from the housing the threads in these machines are also provided with a metal adhesive before being screwed in. In order to disassemble the end piece the machine housing must likewise be heated in the thread region so as to break the adhesive connection. The screw connection can subsequently be loosened by means of suitable spanners and, if necessary, additional heavy hammer blows, and then unscrewed. This kind of connection between the control pipe and the housing has various disadvantages.

The control pipe has to be secured so that it extends exactly centrally in the axial direction relative to the machine housing and the striking piston so as to avoid leakage between the striking piston and the control pipe and jamming and excessive wear between the control pipe and the striking piston. This can however only be achieved with difficulty with non-centering thread connections. Furthermore the dismantling of the control pipe just described often results in damage to the intermediate piece and the housing. Owing to the rigid connection between the housing, the intermediate piece and the control pipe the vibration and shock caused by the rapid blows of the piston are transmitted undamped to the control pipe and the connection with the compressed air hose. In the case of prolonged use and in difficult operating conditions fatigue fractures can result, in particular in the rear part of the housing of the ram boring machine. The compressed air hose can also become detached from the control pipe so that it must generally be permanently connected to the control pipe by means of a compression sleeve.

OBJECT OF THE INVENTION

The object underlying the invention is to avoid the aforementioned disadvantages in known ram boring machines and in particular to improve the installation of an elastic intermediate piece or spring suspension block and in addition to also keep shock and vibration away from the compressed air hose.

SUMMARY OF THE INVENTION

This object is achieved according to the invention if the elastic intermediate piece is held axially on the control pipe and or in the housing by radial projections so that screw threads do not have to be used to secure the intermediate piece to the housing and to the control pipe. The intermediate piece can be mounted easily and only needs to be pushed into the housing. The elasticity of the intermediate piece is sufficient and ensures that the head of the control pipe matches the striking piston; precise axial alignment of the control pipe is thus no longer necessary.

To simplify installation and disassembly a front radial projection can be arranged in the housing against which the front end of the intermediate piece bears. The rear end of the intermediate piece can either be secured by a stop edge in the housing which is formed by flanging the end of the housing, or else a groove is made at the back in the housing in which a securing ring engages. A pressure plate can be arranged between the intermediate piece and the securing ring.

In the case of one advantageous multi-part securing ring it is proposed that the pressure plate be provided with a securing edge. In particular when installing a multi-part securing ring, i.e. one comprising at least two ring segments, the securing edge prevents the ring from falling inwards. The securing ring can have any cross-section, but advantageously it is circular.

The intermediate piece can comprise an elastomer ring with axial air outlet openings; it can easily be pushed over the peripheral locking projection on the control pipe.

Since the control pipe with the hose connection is no longer subjected to the heavy blows and vibration of the housing and there is no longer a danger of it becoming detached the compressed air hose can advantageously be attached to the control pipe by means of a screw coupling. The ram boring machine as a whole has a longer service life.

BRIEF DESCRIPTION OF THE DRAWINGS

The invention will now be explained in more detail with reference to exemplary embodiments shown in the drawings, in which.

DETAILED DESCRIPTION OF PREFERRED EMBODIMENTS OF THE INVENTION

Figure 1:
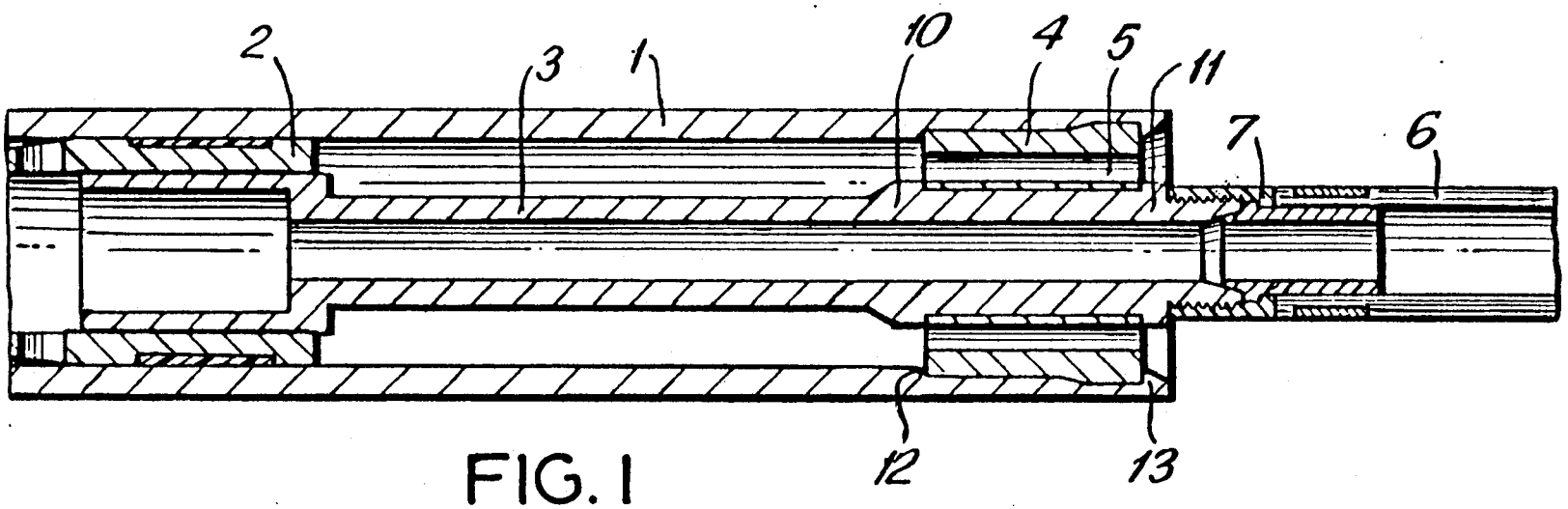
FIG. 1 shows, in longitudinal section, a first embodiment of a ram boring machine according to the invention.

Only the rear end of the ram boring machine is shown in each case. It comprises a housing 1, in which a striking piston 2 moves back and forth. The movement of the striking piston is controlled by means of a control pipe 3 which is supplied with compressed air via a compressed air hose 6. The control pipe 3 is connected to the housing 1 by means of an intermediate piece 4. The intermediate piece 4 consists of an elastic material, e.g. rubber or polyurethane, and prevents the blows and vibrations transmitted by the striking piston 2 to the housing 1 from reaching the control pipe 3 and the compressed air hose 6 undamped. The compressed air supplied through a bore in the control pipe 3 escapes into the atmosphere after the working strokes of the striking piston 2 via axial air outlet openings 5 in the intermediate piece 4 that are concentric with the control pipe 3. The compressed air hose 6 is connected to the control pipe 3 by means of a screw coupling 7.

The intermediate piece 4 is secured in the axial direction on the control pipe 3 by a front radial projection 10 and a rear radial projection 11. The intermediate piece 4 is secured in the rear end of the housing 1 in a similar manner. Analogously thereto, the housing has a front radial projection 12 and a rear radial projection 13.

A sufficiently elastic intermediate piece 4 that is connected to the housing 1 and the control pipe 3 by inserting it in the locking projections allows the intermediate piece 4 to be pushed over the rear end of the control pipe 3 until it is held between the projections 10, 11. In the same manner the control pipe 3 with the intermediate piece 4 can then be pushed from the rear end into the housing 1: this is facilitated by a bevel on the rear projection 13.

Figure 2:
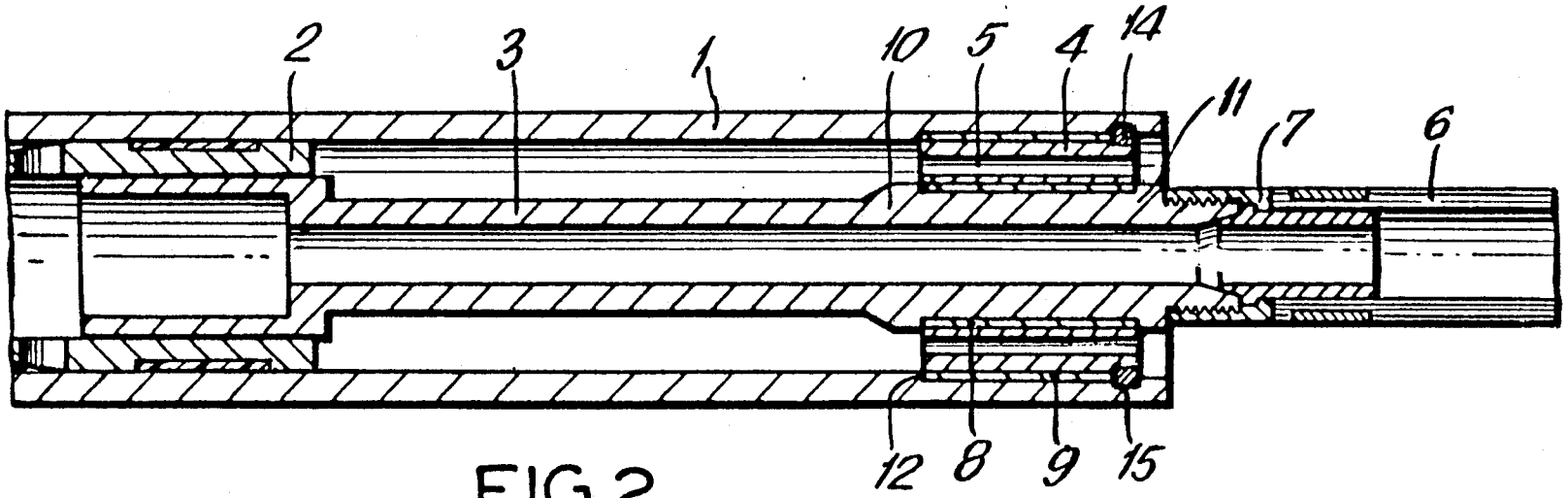
FIG. 2 shows, in longitudinal section, a further embodiment of a ram boring machine according to the invention.

In the embodiment shown in FIG. 2 the intermediate piece 4 has an inner and an outer metal sleeve 8, 9 attached, for example, by vulcanization. These metal sleeves 8, 9 assist in the secure axial seating of the intermediate piece 4 relative to the housing 1 and the control pipe 3. In order to be able to instal and remove the intermediate piece 4 easily an elastic securing ring 14 that is inserted after the intermediate piece 4 has been pushed in is located in a groove 15 in the housing 1. This securing ring 14 can be removed again with the intermediate piece 4 to dismantle the control pipe 3.

Figure 3:
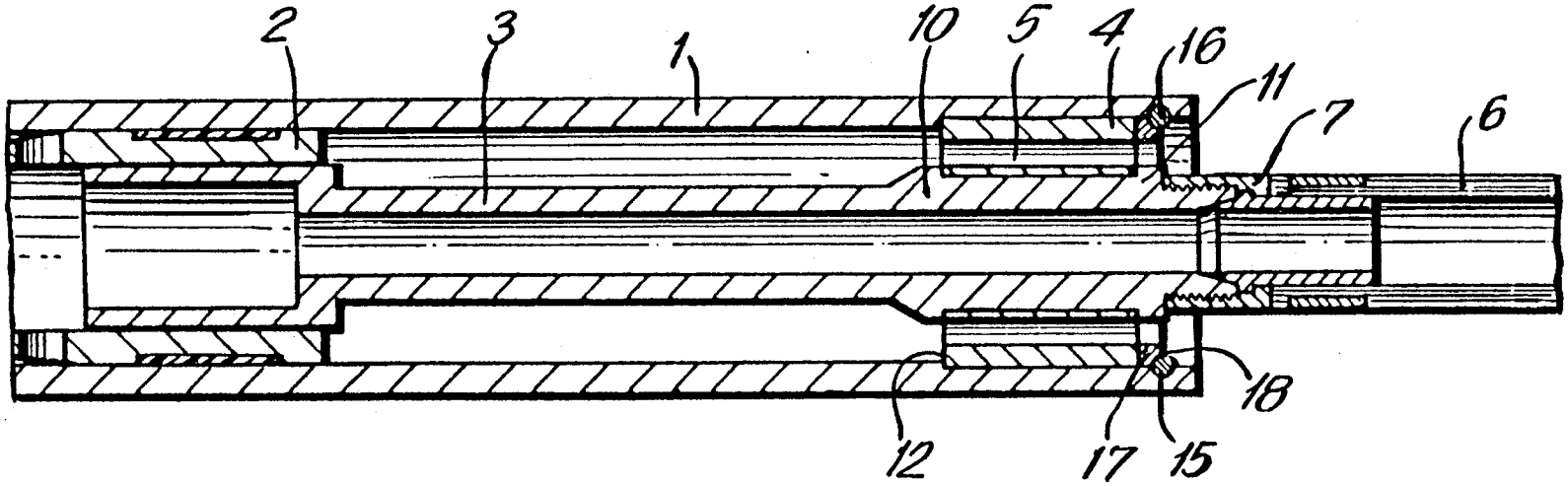
FIG. 3 shows, in longitudinal section, a third embodiment of a ram boring machine according to the invention.

In the exemplary embodiment shown in FIG. 3 the securing ring 16 has a circular cross-section, and arranged between the securing ring 16 and the intermediate piece 4 is a pressure plate 17 which ensures that it lies flush against the intermediate piece 4. The pressure plate 17 is provided with a securing edge which prevents the possibly multi-part securing ring 16 from collapsing radially, i.e. inwardly, after being mounted.

What is claimed is:

1. A ram boring machine having a striking piston that moves axially in a housing and whose movements are controlled by a control pipe that is connected to compressed air hose and is mounted in an elastic intermediate piece arranged in the housing, wherein said intermediate piece is held in position by means of radial projections from at least one of said control pipe and said housing, said projections including a front radial projection (12) around said housing and a removable rear securing ring (14, 16) engageable in a groove (15) in the housing (1), and a pressure plate (17) being arranged between the intermediate piece (4) and the securing ring.

2. A ram boring machine according to claim 1 wherein said securing ring consists of elastic material.

3. A ram boring machine according to claim 1 wherein said pressure plate is provided with a securing edge.

4. A ram boring machine according to claim 1, wherein said intermediate piece comprises an elastomer ring having axial air outlet openings.

5. A ram boring machine according to claim 1, wherein said compressed air hose is secured to the control pipe by means of a screw coupling.

* * * * *